US005524801A

United States Patent [19]

Dooley et al.

[11] Patent Number: 5,524,801

[45] Date of Patent: Jun. 11, 1996

[54] STICK FORM SIZE INDICATORS AND METHOD OF ASSEMBLY TO GARMENT HANGERS

[75] Inventors: Edward J. Dooley, Holland; Robert Bredeweg; Russell O. Blanchard, both of Zeeland, all of Mich.

[73] Assignee: Batts, Inc., Zeeland, Mich.

[21] Appl. No.: 164,237

[22] Filed: Dec. 9, 1993

[51] Int. Cl.[6] ..... A47G 25/14

[52] U.S. Cl. ..... 223/85; 40/322

[58] Field of Search ..... 223/85, 88, 92, 223/95; 211/113; 40/322

[56] References Cited

U.S. PATENT DOCUMENTS

| | | | |
|---|---|---|---|
| 3,543,681 | 12/1970 | Klenz | 101/44 |
| 3,949,914 | 4/1976 | Ostroll | 223/85 |
| 4,115,940 | 9/1978 | Phillips | 223/85 |
| 4,733,460 | 3/1988 | Auger et al. | 29/811 |
| 4,997,114 | 3/1991 | Petrou | 223/85 |
| 5,096,101 | 3/1992 | Norman et al. | 223/85 |
| 5,199,608 | 4/1993 | Zuckerman | 223/85 |
| 5,238,159 | 8/1993 | Zuckerman | 223/85 |
| 5,305,933 | 4/1994 | Zuckerman | 223/85 |

FOREIGN PATENT DOCUMENTS

| | | | |
|---|---|---|---|
| 2543333 | 3/1983 | France | 223/85 |
| 427742 | 7/1967 | Switzerland | 223/85 |

*Primary Examiner*—C. D. Crowder
*Assistant Examiner*—Bibhu Mohanty
*Attorney, Agent, or Firm*—Baker & McKenzie

[57] ABSTRACT

A combination garment hanger, garment size indicating system and method of installing the garment size indicating system is provided in the form of a garment hanger equipped with a tab-holding section that accommodates a size-indicating tab. The size-indicating tab is provided in stick or coil form for easy installation. Once the size-indicating tab is inserted into the tab-holding section, it is substantially unremovable without the use of a pronged or otherwise sharp tab-removing tool. Any removal of the tab from the tab-holding section will substantially damage the tab and render it useless. The tab and method of installing the tabs is ergonomically designed to reduce the likelihood of carpal tunnel syndrome in assembly-line workers charged with the task of installing the tabs on the garment hangers.

6 Claims, 2 Drawing Sheets

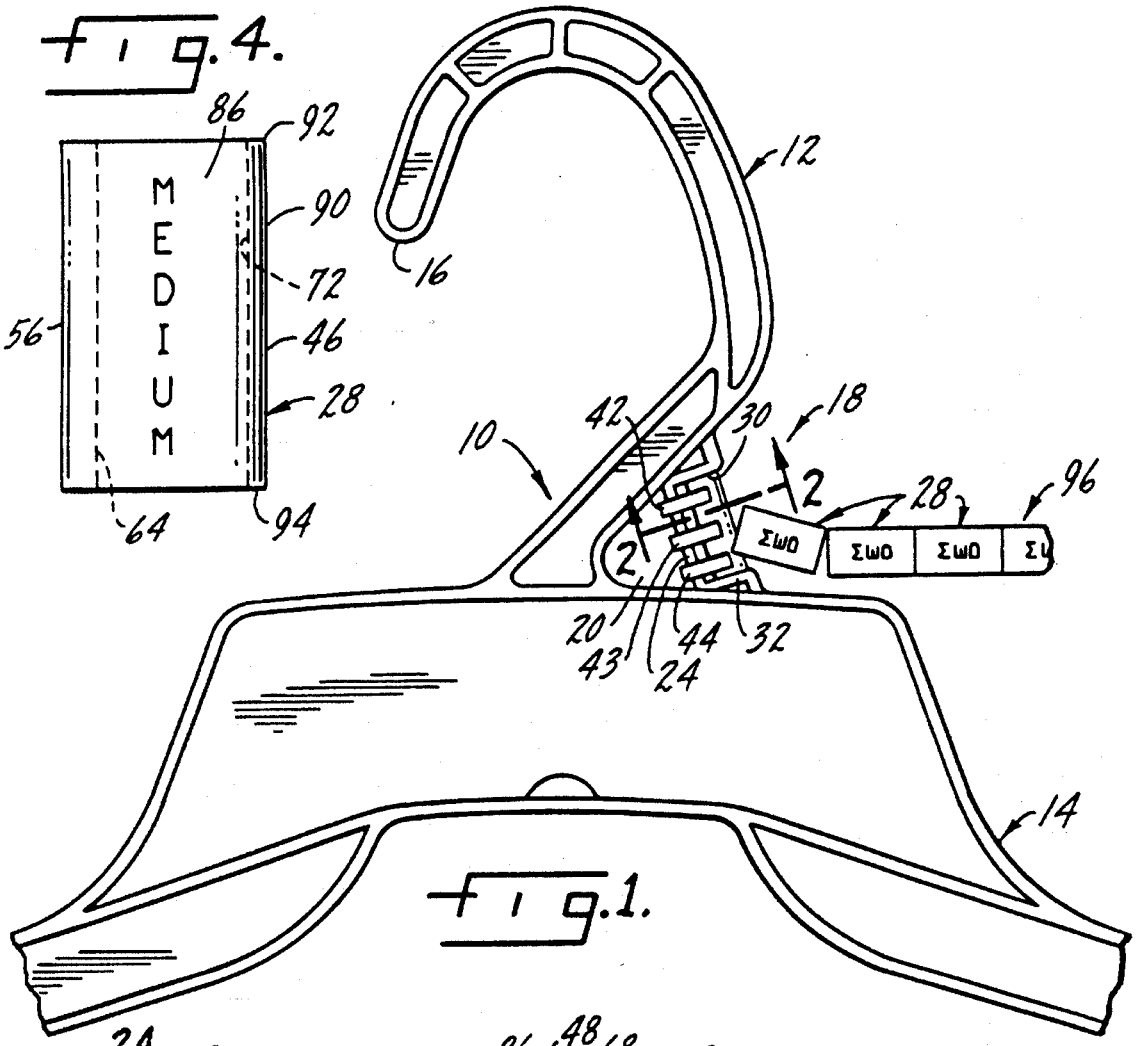
fig.1.
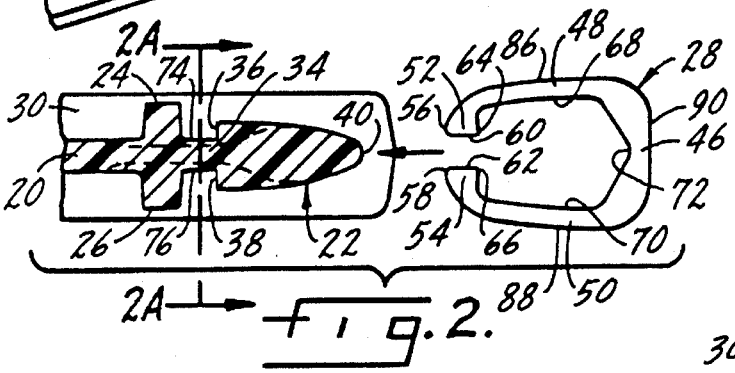
fig.2.
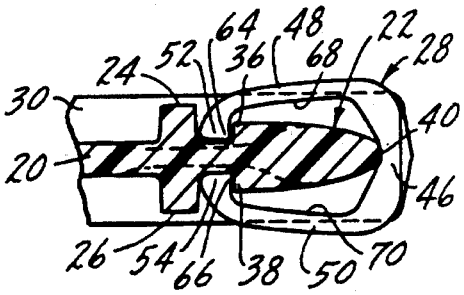
fig.3.
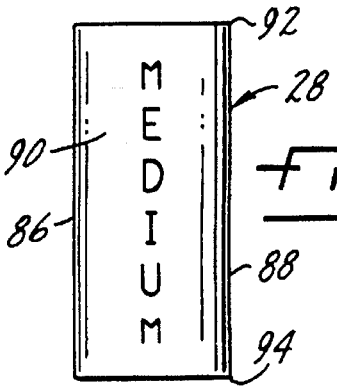
fig.5.
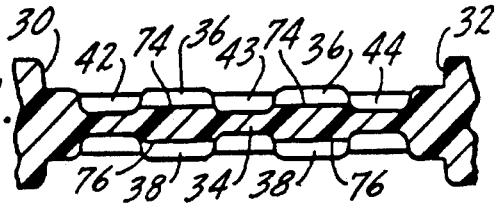
fig.2A.
fig.4.

STICK FORM SIZE INDICATORS AND METHOD OF ASSEMBLY TO GARMENT HANGERS

FIELD OF THE INVENTION

This invention relates generally to an improved system for indicating the size of a garment suspended from a garment hanger. Specifically, this invention relates to an improved system for easily indicating the sizes of the garments on hangers in retail outlets. Structurally, the garment hanger is equipped with a size-indicating tab that cannot be easily removed from the hanger after it is attached thereto without destroying the tab. The tab is provided in stick form to decrease the assembly time and improve the manufacturing process for size-indicating garment hangers.

BACKGROUND OF THE INVENTION

The concept of a garment hanger that includes a label for indicating the size of the garment hung thereon is well-known. One early example of a size-indicating tab is provided in U.S. Pat. No. 3,949,914 issued to Ostroll. The Ostroll patent discloses a tab that is simply snapped on to the hook member of the garment hanger and is easily removable from the hook member of the garment hanger. The problem associated with these types of tabs is that small children may easily remove them from the garment hangers, swallow them and then choke on the tabs. Hence, it became desirable to find a size-indicating tab that was child-proof or at least very difficult to remove once attached to the hanger.

Two examples of size-indicating tabs that are difficult to remove from the hangers are provided in U.S. Pat. Nos. 5,096,101 to Norman and 5,119,608 to Zuckerman. The Norman reference includes a tab with two opposing side members with inwardly curved ends. Each side member includes inwardly protruding fingers that engage an arrow-shaped tab-holder disposed on the garment hanger. The capture of the fingers in an enlarged section underneath the base of the arrow-shaped holder precludes an easy removal of the tab from the hanger once in place.

However, the use of the inwardly protruding fingers disposed on the inner surface of either opposing side member creates a tab design that is difficult to mold and therefore difficult to manufacture. The Zuckerman reference also employs a similar design. A generally U-shaped tab with inwardly slanted side walls include two inwardly protruding members or fingers that are captured underneath the base of a ridge. In order to remove the U-shaped tab of Norman or Zuckerman, one would have to grasp the opposing side members and spread them far enough so that the inwardly protruding members or fingers would clear the tab holding section. Both Norman and Zuckerman include protective ribs that prevent even small child-size fingers from obtaining a purchase on the opposing side members and therefore prevent small fingers from grasping and spreading the opposing side members.

While both Norman and Zuckerman provide a substantial advancement to the prior art, two problems still remain. First, the inwardly protruding finger or member disposed in the inner surface of an opposing side member of the tab presents a significant problem in terms of mold design. It would be preferable, and easier to design a tab that has a substantially flat inner surface or at least an inner surface without a projecting part or member. By eliminating the projecting part or finger disposed on the inside surface of the opposing side members, the tabs could also then be provided in a strip or stick form. By providing the tabs in a strip or stick form, the assembly-line worker would have a strip of tabs and could insert them and break them off one at a time. A strip or stick form could also be applied to garment hangers via machine or mechanical device.

It will also be noted that tabs with inwardly projecting fingers or members also require the assembly-line worker to impart undue amounts of twisting and pushing forces in order to install the tab on the garment hanger.

Thus, a need exists for an improved size-indicating tab that is easier for the assembly-line worker to install on a garment hanger and easier to manufacture. The size-indicating tab must also include the non-removable aspects previously known so as to not create a child-safety problem.

SUMMARY OF THE INVENTION

The present invention makes a significant contribution to the garment hanger art by providing an improved size-indicating system, an improved tab and improved method of installing the tab on the hanger. The hanger resulting from the present invention is safe to use in homes with small children and is further easy to manufacture and avoids requiring the assembly-line worker to perform an excessive amount of grasping, twisting or turning which may lead to development of carpal tunnel syndrome.

The improved tab includes two opposing side members and a front end disposed between the two opposing side members. The opposing side members extend rearward and terminate at inwardly curved ends or inwardly extending ends. The curved ends of the opposing side members terminate at abutting surfaces adapted to abut an associated tab holder or substantially flat inner walls. Each flat inner wall is disposed between a square edge disposed toward the front end and an outer rounded edge. The curved ends of the opposing side members are resiliently biased inward toward each other.

The tab engages the tab-holder disposed between the garment support section of the hanger and the hook or hang means. A wall connects the tab-holder to the hanger and extends outward or frontward along one side of the garment support member and terminates in a flared base portion of the tab-holder. The wall defines a thickness that is substantially equal to the difference between the flat inner walls of the inwardly curved ends of the opposing side members of the tab when the tab is in a relaxed position. The tab-holder extends frontward from the flared base portion and terminates at a tapered front end. The inside surface of the front end of the tab includes a slot for accommodating the tapered front end of the tab-holder.

As the tab slides over the tab-holder, the curved outer edges of the inwardly curved ends of the opposing side members of the tab slide over the tapered front end of the tab-holder and over the flared rear end of the tab-holder and engage the receiving sections of the wall disposed immediately rearward of the flared rear end of the tab-holder. The tapered front end of the tab-holder is received in a slot disposed in the inside front wall of the front end of the tab.

A child or anyone else is precluded from removing the tab from the tab-holder without a sharp tool in two ways. First, the inner square edge of the inwardly curved ends engages the flared rear end of the tab-holder and will not slide outward over the flared rear end of the tab-holder without a substantial prying action which would require a sharp instrument. Further, the wall that connects the tab-holder to the hanger includes two opposing outwardly projecting ribs.

The two outwardly protruding ribs and the flared rear end of the tab-holder define the two sections that receive the flat inner walls of the inwardly curved ends of the tab after installation of the tab over the tab-holder. The two opposing ribs prevent even the smallest hands from obtaining a purchase on the outer curved edges of the inwardly curved ends of the tab. Accordingly, the tab cannot be removed from the tab-holder without a sharp instrument.

It will be noted that the ribs and the flared rear end of the base member may include slots for accommodating a tab-removal tool in the event that an incorrect tab is mounted on the hanger and needs to be removed. The narrow channels do not compromise the child-proof qualities of the hanger and tab because they are too narrow for even the smallest fingers to extend through.

Because the opposing side members of the tab do not include any finger, member or other protuberance, a strip of tabs may be easily manufactured by molding a single elongated tab and placing a series of equally spaced cuts through the opposing side members that fall short of the front end of the tab. The result will be a series of tabs provided in stick form whereby the tab disposed at the distal end of the stick may be easily snapped off as it is inserted on to the tab-holding section of the garment hanger. An even larger quantity of tabs may be provided in a coiled form of still varying quantities and lengths. The use of the size-indicating tabs and stick or coil form greatly reduces wasted time and motion associated with orientating the tabs prior to each application of a tab to a garment hanger. The operator may simply hold the stick upward, insert the tab disposed at the distal end of the stick or coil on to the tab-holding section of the garment hanger and as the tab is inserted over the tab-holding section the tab will break off the end of the stick and the operator is in position and ready to insert the next tab on the next garment hanger. The repetitive motion carried out by the assembly-line worker is greatly reduced.

Further, the size-indicating tabs provided in stick or coil form may also be more easily applied by a machine, applicator gun or other mechanical device.

Accordingly, it is an object of the present invention to provide an improved size-indicating tab for garment hangers.

Another object of the present invention is to provide an improved size-indicating tab for garment hangers that is easier to install and easier to manufacture.

Yet another object of the present invention is to provide an easy-to-install, easy-to-manufacture size-indicating tab that may be also used in homes with small children without creating any substantial risk to the safety of the children.

BRIEF DESCRIPTION OF THE DRAWINGS

This invention is illustrated more or less diagrammatically in the accompanying drawings, wherein:

FIG. 1 is a partial front elevational view of the garment hanger, tab-holder and stick or coil of tabs made in accordance with the present invention;

FIG. 2 is a sectional view taken substantially along line 2—2 of FIG. 1;

FIG. 2A is a sectional view taken substantially along the line 2A—2A of FIG. 2;

FIG. 3 is the same sectional view shown in FIG. 2 illustrating the tab after it has been inserted over the tab-holder;

FIG. 4 is a left side elevational view of a tab made in accordance with the present invention illustrating the left side display wall;

FIG. 5 is a front elevational view of the tab illustrated in FIG. 4 illustrating the front display wall;

Figure 6:
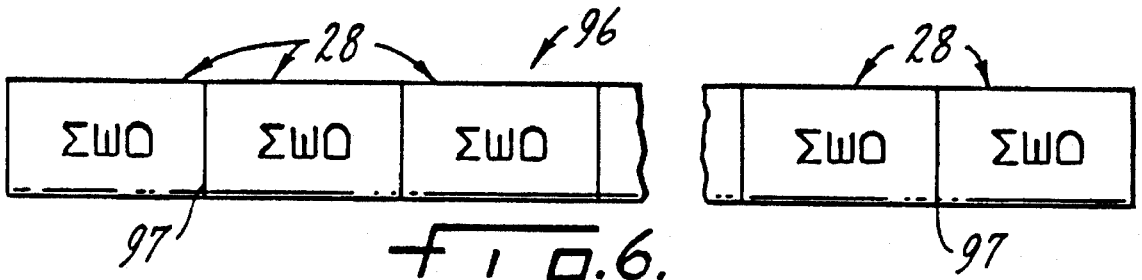
FIG. 6 is a left side view of a coil or stick of tabs made in accordance with present invention illustrating the cuts disposed in the opposing side members thereof.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

As seen in FIG. 1, the garment hanger 10 includes a hang means 12 which is connected to a garment support member 14. In the retail environment, the distal end 16 of the hang means or hook 12 is hung over a rack (not shown) and is directed away from the consumer. Therefore, the tab-holding section, indicated generally at 18 (see also FIGS. 2 and 3), is directed toward the consumer. The tab-holding section 18 is also preferably connected to both the hang means 12 and garment support member 14 by the wall 20.

Referring to FIGS. 1 through 3 collectively, the tab-holding section 18 includes the wall 20 which is connected to the hang means 12 as well as the garment support member 14. The wall 20 extends outward and is connected to the tab-holder 22. A pair of outwardly protruding ribs 24, 26 are disposed along the wall rearward of the tab-holder 22. The ribs 24, 26 provide structural support to the tab-holding section 18 and the ribs 24, 26 block access to the tab 28 after installation as explained below. The upper rib 30 and lower rib 32 also block access to the tab 28 after installation of the tab 28 on to the tab-holder 22.

The tab-holder 22 is best illustrated in FIGS. 2 and 3. The flared base portion 34 is connected to the wall 20 and includes two outwardly projected ledges 36, 38. The outward distal end of the tab-holder 22 features a tapered front end 40. In the embodiment shown in FIGS. 2 and 3, the tab-holder 22 is bullet-shaped. The slots or channels 42, 43, 44 (see FIG. 1) are intended to accommodate a tab-removing tool (not shown) in the event an incorrect size-indicating tab is mounted over the tab-holder 22. However, the channels 43, 43, 44 are sufficiently narrow so as to preclude a small child's finger from obtaining a purchase on the curved ends 52, 54 of the tab 28 (see below). The channels 42, 43, 44 extend from through the ribs 24, 26, through the receiving sections 74, 76 and through the ledges 36, 38 to enable an assembly-line worker to quickly pry the curved ends 52, 54 of the tab 28 over the ledges 36, 38 with an appropriate tool (not shown).

Still referring to FIGS. 2 and 3, the tab 28 includes a front end 46 disposed between two opposing side members 48, 50. Each opposing side member 48, 50 terminates in an inwardly curved end 52, 54 respectively. Each curved end 52, 54 features a rounded outer edge 56, 58 respectively, a flat inner wall 60, 62 respectively, and a squared or sharp inner edge 64, 66 respectively. The inner walls 68, 70 of the opposing side members 48, 50 respectively are substantially smooth and free of abutments and protuberances. The inner wall of the front end 46 features a slot or groove 72 that accommodates the tapered front end 40 of the tab-holder 22. The receiving sections 74, 76 of the wall 20 receive the flat inner walls 60, 62 of the inwardly curved ends 52, 54 respectively upon installation of the tab 28 over the tab-holder 22.

Still referring to FIGS. 2 and 3, upon installation, the outer rounded edges 56, 58 of the ends 52, 54 of the tab first engage the tapered front end 40 of the tab-holder. The rounded edges 56, 58 slide smoothly over the tab-holder 22 and the flared base portion 34 of the tab-holder 22. When the tab 28 has been pushed far enough over the tab-holder 22, the curved ends 52, 54 and specifically the flat inner walls 60, 62 of the curved ends 52, 54 respectively are received in the receiving sections 74, 76 of the wall 20 (see FIG. 3).

Removal of the tab 28 from the tab-holder 22 is precluded by the complementary structures of the tab 28 and the tab-holding section 18. Specifically, the ribs 24, 26 (despite the access channels 42, 43, 44) prevent small fingers from obtaining a purchase or grip on the curved outer edges 56, 58 of the tab 28. Second, the engagement of the sharp or squared inner edges 64, 66 against the ledges 36, 38 of the flared base portion 34 prevent the tab 28 from being grasped by its opposing side members 48, 50 and pulled off of the tab-holder 22. The mating-type engagement of the tapered front end 40 of the tab-holder 22 in the slot 72 disposed in the front end 46 of the tab 28 provides a relatively tight fit of the tab 28 over the tab-holder 22 and therefore precludes manipulation of the tab 28 by a child in an attempt to remove the tab 28 from the tab-holding section 18 of the garment hanger 10. In addition, the upper rib 30 and lower rib 32 (see FIG. 1) also preclude small fingers from obtaining a purchase on the tab 28.

Turning to FIGS. 4 and 5, the size of the garment may be indicated on the outer display walls 86, 88 (see also FIG. 2) of the opposing side members 48, 50 respectively as well as the front display wall 90 (see also FIG. 2) for a clear indication of the size of the garment from three sides. The front end 46 or front display wall 90 of the tab 28 also includes an upper edge 92 and lower edge 94. The upper edge 92 and lower edge 94 are detachably connected to adjacent tabs 28 when the tabs are provided in a stick or coil of tabs as shown in FIGS. 1, 6 and 8.

Figure 8:
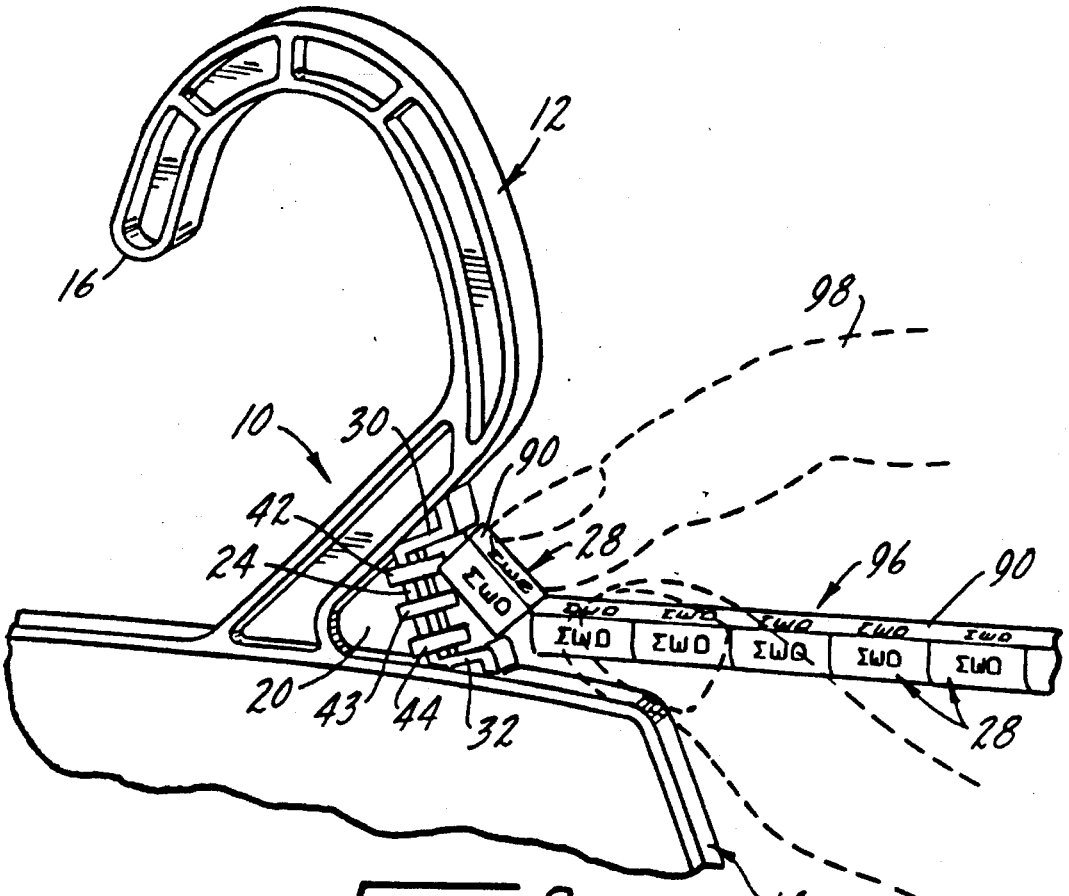
FIG. 8 is a perspective view of a garment hanger, tab-holder and stick or coil of tabs made in accordance with the present invention particularly illustrating the ease of installation of a tab on a tab-holder while the tab is connected to a stick of tabs.

Turning to FIG. 8, an improved method of installing a size-indicating tab 28 on a garment hanger 10 is illustrated. Using the stick or coil of tabs 96 that has been severed or cut at the opposing side walls 48, 50 to provide a stick of tabs 28 connected at the upper and lower edges 92, 94 of the front ends 46, an operator may insert a first tab 28 on to the tab-holding section 18 of the garment hanger 10 and the lower edge 94 of the front wall 90 will easily snap off of the adjacent tab. The operator maintains control of the stick or coil of tabs 96 and is ready to quickly insert the next tab 28 on to the next tab-holding section 18 of the next garment hanger 10. Minimal dexterity is required because the operator need not pick up a small tab 28 from a dish or tray of tabs, line it up against the tab-holding section 18 of a garment hanger 10 and then insert the small tab 28 on to the tab-holder 22. The stick or coil of tabs 96 provided by the detachable connections of the upper and lower edges 92, 94 of the front walls 90 of the tabs enables an operator to handle the small tabs 28 with greater ease and further improves the speed at which the tabs 28 may be installed on to the hangers 10.

Figure 7:
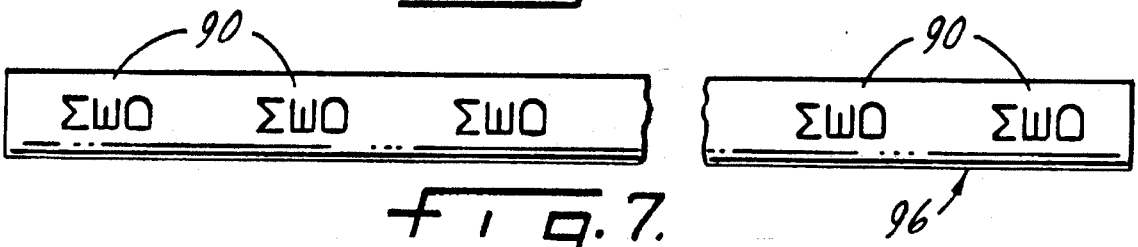
FIG. 7 is a front view of a coil or stick of tabs made in accordance with the present invention.

FIGS. 6 and 7 illustrate a stick or coil 96 of tabs 28 that are made from molding a series of tabs 28 and then placing a series of equally spaced cuts or slits 98 through the opposing side members 48, 50 (see FIGS. 2 and 3) but leaving the front display walls 90 connected to each other. As seen in FIG. 8, the connection of one tab 28 to another tab 28 at the front end 46 or front wall provides a detachable connection and the tab 28 being installed on to the tab-holding section 18 of a garment hanger 10 will naturally snap off the distal end of a stick or coil 96 of tabs 28. The operator then maintains possession and control of the stick or coil 96 of tabs 28 and is ready to install the next tab 28 disposed at the distal end of the stick or coil 96 of tabs onto the next succeeding garment hanger 10.

Thus, a new sizing system is provided for the garment industry which is both easier and faster to install which reduces the aggravation and strain associated with carpal tunnel syndrome as well as provides a hanger that is safe for use in homes with small children. The tab 28 may be installed by pushing inward on the tab 28 disposed at the distal end of a stick or coil 96 of tabs 28. The lack of any fingers or protuberances on the inner surfaces 68, 70 of the opposing side members 48, 50 substantially decreases the amount of rocking or twisting involved in installing a tab 28 over the tab-holding section 22. The accommodation of the tapered front end 40 of the tab-holder 22 in the slot 72 of the front end 46 of the tab in combination with the engagement of the flat inwardly facing walls 60, 62 with the receiving section 74, 76 provides a rocking-free stability of the tab once installed on the hanger. The stability afforded by the installed tab 28 precludes removal of the tab 28 from the hanger 10. As seen in FIG. 8, the tab 28 may be installed easily by engaging an index finger 98 with the front display surface 90 of the tab 28 and pushing the tab 28 onto the tab-holder 22.

Because the opposing side members 48, 50 would have to be stretched substantially outward in order to remove the tab 28 from the hanger 10, the tab 28 would be substantially damaged and rendered useless if it were successfully removed. Rendering the tab 28 useless after one removal ensures that worn or structurally tired tabs 28 will not be installed on hangers 10 which may find their way into the homes of consumers with small children. The complementary structures of the tab 28 and the tab-holding section 18 ensure that the tab 28 will be used only once.

Although only one preferred embodiment of the present invention has been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

We claim:

1. A system for indicating the size of a garment hung on a garment hanger, the system comprising:

a garment hanger equipped with a tab-holder and a tab, a wall connecting the tab-holder to the hanger, the wall extending frontward and terminating at a base portion of the tab-holder, the base portion of the tab-holder extending outwardly away from the wall on least one side of the wall, the tab-holder extending frontward and terminating at a front end, the wall further including two outwardly extending and opposingly directed ribs disposed along the wall between the hanger and the base portion of the tab-holder, the ribs being disposed in a generally parallel relationship with the base portion of the tab-holder, at least one channel extending generally perpendicularly through a rib add the outwardly extending portion of the base portion of the tab-holder, said channel for accommodating a tab-removing tool in the event the tab is to be removed from the hanger, the tab including opposing side members with a front wall disposed between the opposing side members, the opposing side members extending rearward and terminating at inwardly extending ends, the opposing side members having smooth inside surfaces which are free of projecting members, the tab being mountable onto the tab-holder so that the inwardly extending ends of the opposing side members of the tab are in abutting engagement with the wall behind the flared base portion of the tab-holder, the inwardly extending ends of the opposing side members being resiliently biased inward toward each other thereby precluding removal of the tab from the tab-holder by hand and without a tab-removing tool being inserted into one of said channels to pry the tab off of the garment hanger.

2. The system of claim 1, wherein the base portion of the tab-holder extends outwardly away from the wall on both sides of the wall, at least one channel extends through each rib and through the outwardly extending base portion of the tab-holder.

3. The system of claim 2, wherein the engagement of the tab over the tab-holder is further characterized in that the inwardly extending ends of the tab are in abutting engagement with the outwardly extending base portion of the tab-holder so that the tab-holder is snugly accommodated between the opposing side members and between the front wall and inwardly extending ends of the tab.

4. The system of claim 2, wherein the tab is generally U-shaped, the front end of the tab-holder is tapered, said front end being accommodated in a seat disposed in an inside surface of the front wall of the tab.

5. The system of claim 4, wherein the tab is provided in the form of a stick of tabs detachably connected together at the front ends thereof.

6. A system for labelling garment hangers to indicate the size of garments hung on the garment hangers and for correcting mislabeled garment hangers, said system including:

a garment hanger;

a size-indicating tab; and means for removing the tab from the hanger;

the garment hanger including a tab-holding section extending from the garment hanger, the tab-holding section comprising a wall having two opposite sides, the wall extending outwardly from the hanger, a tab-holder member located at an outer portion of the wall, rib means carried by the wall and located rearwardly from the tab-holder member, said rib means and tab holder defining a receiving section, said receiving section, said receiving section being disposed between said rib means and the tab-holder member, the tab including opposing side members extending rearward and terminating at inwardly extending ends, at least one end being in abutting engagement with a said receiving section; and the means for removing the tab from the hanger includes at least one channel formed in one side of the wall and extending through the rib means on said one side of the wall and into said receiving section the inwardly extending end of the tab, when in contact with the said receiving section being spaced away from the bottom of the channel a distance sufficient to enable said means for removing the tab to extend into the space between the inwardly extending end of said tab and the bottom of the channel and obtain a purchase under the end of the tab resting on said one receiving section.

* * * * *